United States Patent [19]

Perlman

[11] Patent Number: 4,883,644

[45] Date of Patent: Nov. 28, 1989

[54] MICROTUBE VORTEXER ADAPTER AND METHOD OF ITS USE

[75] Inventor: Daniel Perlman, Arlington, Mass.

[73] Assignee: Brandeis University, Waltham, Mass.

[21] Appl. No.: 130,412

[22] Filed: Dec. 9, 1987

[51] Int. Cl.[4] ..... B01L 9/00; B01F 11/00

[52] U.S. Cl. ..... 422/104; 366/110; 422/99; 422/310

[58] Field of Search ..... 422/99, 102, 104, 72, 422/99, 102, 104; 366/208, 209, 213, 214, 220, 110–112

[56] References Cited

U.S. PATENT DOCUMENTS

| | | | |
|---|---|---|---|
| 586,324 | 7/1897 | Teegarden | 366/111 X |
| 1,619,526 | 1/1927 | Meeker et al. | 366/208 |
| 2,247,978 | 7/1941 | Van Arkel | 366/110 |
| 3,071,316 | 1/1963 | Piemonte et al. | 422/72 X |
| 3,720,502 | 2/1973 | Grooper et al. | 422/72 X |
| 3,882,716 | 5/1975 | Bieman | 422/72 X |
| 4,042,218 | 8/1977 | Moore et al. | 366/111 |
| 4,118,801 | 10/1978 | Kraft et al. | 366/111 |
| 4,202,634 | 5/1980 | Kraft et al. | 366/111 |
| 4,236,666 | 12/1980 | Aeschlimann et al. | 422/72 X |
| 4,304,356 | 12/1981 | Chulay et al. | 366/213 X |
| 4,305,668 | 12/1981 | Bilbrey | 422/99 X |
| 4,510,119 | 4/1985 | Hevey | 422/104 X |
| 4,555,183 | 11/1985 | Thomas | 422/99 X |

OTHER PUBLICATIONS

Fisher–Scientific advertisment.

*Primary Examiner*—Barry S. Richman
*Assistant Examiner*—Amalia L. Santigao

[57] ABSTRACT

A vortex adapter, and method of its use, suitable for holding a plurality of tubes to be vortexed, comprising: an elongated handle; a base fixed to the handle, the base comprising a plurality of holding means, wherein a tube can be positioned within each holding means; and a nipple fixed to the base, wherein the nipple can be inserted into a cup of a vortexing machine, and wherein when the nipple is inserted into the cup and the cup is caused to vibrate the tubes held within the holding means are subject to vortex forces from the cup.

10 Claims, 2 Drawing Sheets

MICROTUBE VORTEXER ADAPTER AND METHOD OF ITS USE

BACKGROUND OF THE INVENTION

This invention relates to adapters for simultaneously subjecting a plurality of tubes to vortex forces.

Motorized circular vibrating instruments termed vortexers or vortexing machines are routinely used in laboratories to assist in resuspending particulate pellets, and in dissolving soluble substances in liquids contained within test tubes or other vessels. The process of resuspension using these machines is commonly termed "vortexing", and the liquid within the test tube is said to be "vortexed". Most commonly, the vortexer machine has a motor which drives a 1–2 inch diameter rubber cup situated above the motor. When the tip of a test tube is inserted into the vibrating rubber cup the liquid contents of the tube are caused to rapidly circulate, creating a vortex effect. The liquid agitation and the transmitted vibrations serve to accelerate the resuspension and dissolution of solids.

To accommodate vessels which are too large to properly vibrate in the rubber cup, larger non-skid rubber platforms have been substituted for the cup. Further, Fisher Scientific produces a horizontal platform containing a plurality of wells which is substituted for the cup to permit the simultaneous agitation of 60 or 96 small tubes or microcentrifuge tubes (microtubes) held in a vertical position.

SUMMARY OF THE INVENTION

In general, the invention features a vortex adapter suitable for holding a plurality of tubes to be vortexed, and a method of using the adapter for vortexing these tubes. The adapter has an elongated handle; a base connected to the handle, the base having a plurality of holding means, wherein a tube can be positioned within each holding means; and a nipple connected to the base, wherein the nipple can be inserted into a cup of a vortexing machine. When the nipple is inserted into the cup and the cup is caused to vibrate the tubes held within the holding means are subject to vortex forces from the cup.

In preferred embodiments, the adapter has a first longitudinal axis, and the tubes have a second longitudinal axis, and the first and second axes form an acute angle to each other, preferably the acute angle is 10°–30° most preferably 16°–18°; the adapter device further comprises a cap slidably mounted on the handle, wherein the cap may be positioned to prevent the tubes from vibrating from the holding means; when a tube is inserted within the holding means the lower portion of said tube extends from the holding means; the adapter is formed from an optically transparent plastic, most preferably the plastic is radiopaque.

The adapter of this invention permits the unattended vortexing of a plurality of tubes, the vortex adapter providing more than adequate vibration and vortexing, especially of liquid in microtubes. More importantly, pellets of biological materials (such as DNAs and proteins) have been found to dissolve rapidly in microtubes being vortexed in this adapter.

The present invention is generally a hand-held or clamp-held vortex adapter, designed for maximizing vortexing action within small tubes. (By clamp-held is meant that the adapter handle is held by a clamp so that the nipple is held within the cup of a vortexer.) These tubes are generally angled from the vertical so that an elliptical or eccentric motion of liquid within the tubes is created. This motion is more effective at dislodging and dissolving solids than the circular motion of liquid within a vertically positioned tube. The force of vibrations from a vortex machine on this adapter may be sufficient to require the presence of a cap to hold tubes within the adapter and to prevent their vibration from the adapter. This cap may be positioned at any point on the handle, to allow the tubes to move up and down to a limited extent within the adapter, thus assisting in disintigration and dissolution of solids in the tubes. The handle of the adapter permits more vigorous vibration of the adapter head than if the head were held directly by hand, or in a clamp, and also allows the angle of the head to be changed to increase the power of the forces in the tubes. For example, it is sometimes appropriate to angle the tubes at 30°–45° from the vertical to increase the elliptical motion of liquid within the tubes. In this situation, the nipple of the adapter head is necessary to maintain contact of the adapter head and the vibrating rubber cup of the vortex machine.

The transparency of the vortex adapter is also a useful and functional design feature. This transparency allows visualization of liquid movement within the tubes during vortexing and thus provides an indication of the effectiveness of the ongoing process.

Microtube vortex adapters of the present invention provide additional benefits besides improving the vortexing action of vortex machines upon microtubes, and permitting the simultaneous vortexing of a plurality of tubes. Since the vortex adapters spacially remove the microtubes from hand or gloved-hand contact, these adapters prevent contamination of the hand by toxic and/or radioactive substances contained within the microtubes. Such substances may include phenol, chloroform, ether, strong acids and bases, toxic salts of cyanides and azides, as well as commonly used radioactive isotopes including $^{32}P$, $^{125}I$, $^{35}S$. Furthermore, when the cap of the adapter is seated firmly down on the caps of the microtubes, it serves to insure that the microtube caps will not open accidentially during vortexing. Such accidental openings have previously been documented and can cause severe contamination of laboratory workers, vortexing equipment and other laboratory surfaces.

Other features and advantages of the invention will be apparent from the following description of the preferred embodiments, and from the claims.

DESCRIPTION OF THE PREFERRED EMBODIMENT

The Figures will first briefly be described.

DRAWINGS

STRUCTURE

Figure 1:
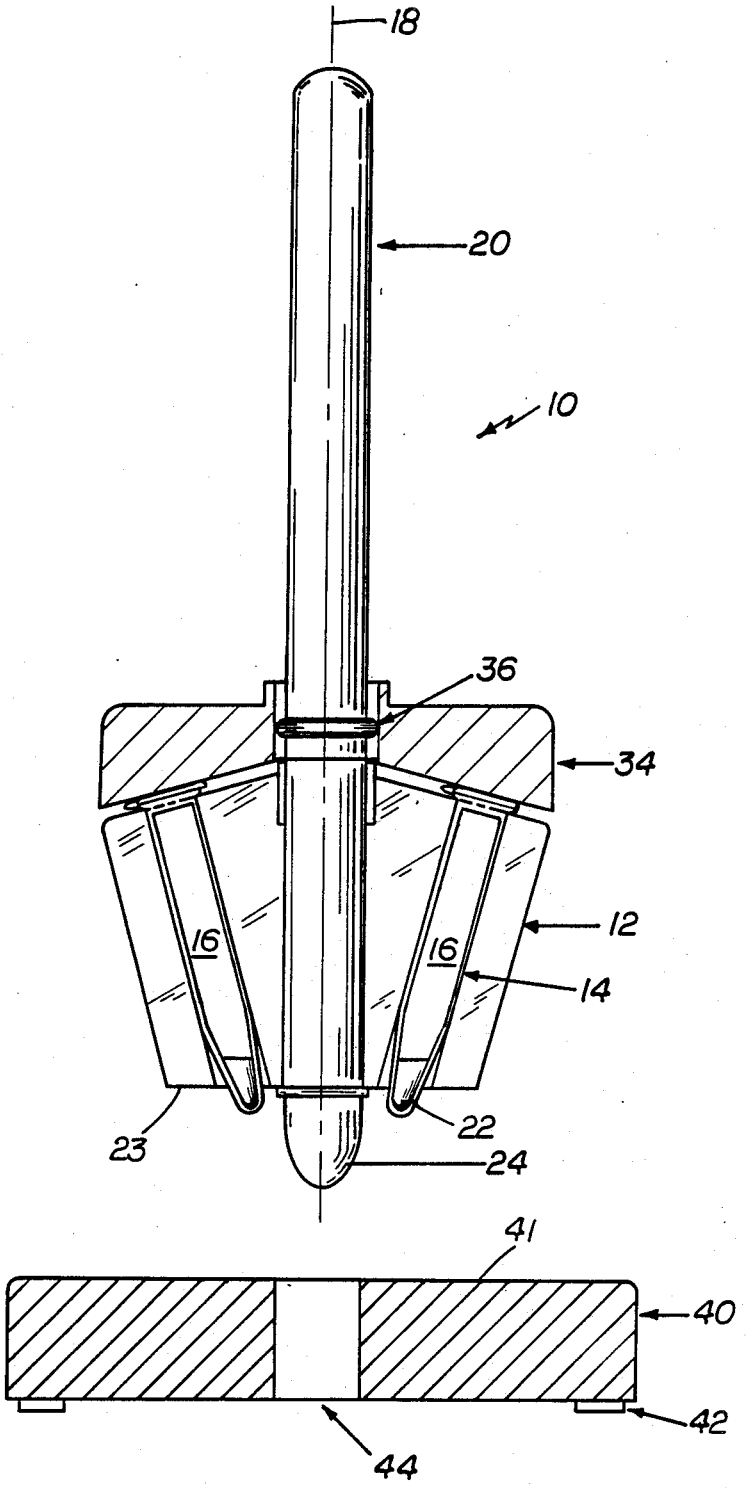
FIG. 1 is a sectional view of a vortex adapter, and a stand.
Figure 2:
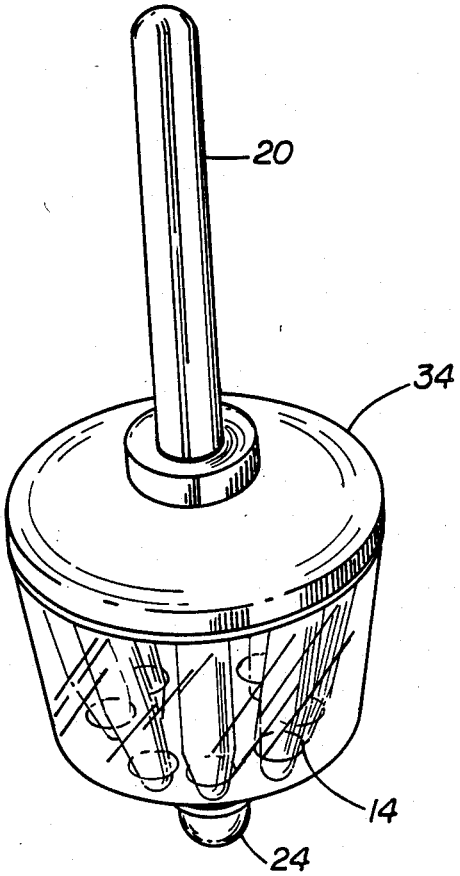
FIG. 2 is a perspective view of a vortex adapter and a vortex machine.
Figure 2:
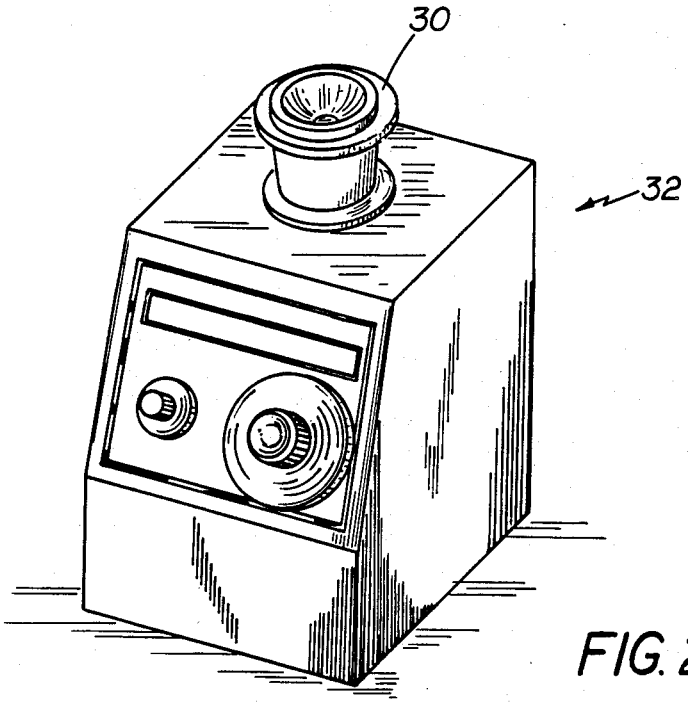

Referring to the Figures, vortex adapter 10 is formed from an adapter head 12 having eight radially positioned bore holes 14 suitable for holding microtubes 16. Bore holes 14 are angled inward (16°–18° from the longitudinal axis 18 of adapter 10) towards the bottom of adapter head 12. A hand-held or clamp-held vortexing handle 20 is provided attached to adapter head 12 and is used to hold adapter 10 to regulate the agitation of liquid 22 in microtubes 16 during vortexing. Holding or clamping handle 20 further from adapter head 12 produces a larger amplitude, lower frequency vibration in tubes 16, whereas holding handle 20 close to adapter head 12 produces a smaller amplitude, higher frequency vibration. A nipple 24 is attached to the bottom of adapter head 12 and serves to position head 12 in a vibrating rubber cup 30 (FIG. 2) of a vortexing machine 32, thereby transmitting vibrations from the machine through adapter head 12 to microtubes 16. An adapter cap 34, able to slide up and down on handle 20 serves to restrain microtubes 16 in their respective bore holes. Adapter cap 34 has an O-ring 36 which serves to fix the position of adapter cap 34 at any position on handle 20. Also provided is an adapter support stand 40 having non-skid feet 42 and seating hole 44, which serves to hold adapter 10 in a vertical position to allow loading and unloading of microtubes 16 from bore holes 14. Contact between the bottom 23 of adapter head 12 and the top 41 of adapter support stand 40 results in upward pressure on microtubes 16. This pressure displaces the microtubes upwards, facilitating their removal from adapter head 12 when adapter cap 34 is raised upwards on handle 20.

Adapter head 12, handle 20 and cap 34 are all formed of clear plastic, e.g., Plexiglass TM, and thus provide some protection from radioactive substances within tubes 16. Adapter 10 is manufactured by standard techniques.

USE

In use, nipple 24 of adapter head 12 is placed in seating hole 44 of support 40 and cap 34 moved upward on handle 20. Microtubes 16 are then placed within adapter head 12, cap 34 slid down over the tubes, and adapter 10 then held by hand, or within a clamp adapter, over cup 30 of vortex machine 32. As cup 30 vibrates, nipple 24 is vibrated and the vibratory motion passed on to tubes 16 and thence liquid 22 within the tubes. Microtubes 16 are removed by reversing the above steps.

OTHER EMBODIMENTS

Other embodiments are within the following claims. For example, tubes 16 may be held within wells, rather than bore holes, and thus completely surrounded by the material of adapter head 12 and cap 34. Similarly, the adapter head may be more flimsy in design, e.g., having shorter bore holes, when protection from radiation is not necessary.

I claim:

1. A vortex adapter suitable for holding a plurality of tubes to be vortexed and for subjecting the tubes simultaneously to vortex forces, said adapter being adapted for use with a vortexing machine having a vibrating cup, said adapter comprising:

an elongated handle;

a base connected to said handle with said handle extending above said base, said base comprising a plurality of fixed apertures sized to receive a plurality of tubes respectively, each of said apertures having an upper portion and a lower portion with said upper portion positioned closer to the top of said base than said lower portion; and a nipple connected to and positioned below said base, wherein said nipple is constructed and configured to be received into the cup of the vortexing machine while said adapter is held at said handle, and wherein said nipple, said base, and said handle are structurally associated in a manner whereby rotation of said nipple by insertion into the cup causes vibration of said base and causes tubes held within said apertures in said base to be subject to vortex forces wherein said adapter has a first longitudinal axis parallel to said handle, and a said aperture forms a second longitudinal axis extending from said upper portion to said lower portion, and wherein said first and second axes form an acute angle to each other wherein the distance of said second axis from said first axis in said upper portion is greater than the distance of said second axis from said first axis in said lower portion.

2. The adapter of claim 1 in combination with a stand adapted to hold said adapter in a vertical position, said stand comprising an aperture adapted to receive said nipple.

3. The adapter of claim 1, wherein said acute angle is 10°–30°.

4. The adapter of claim 3 wherein said angle is 16°–18°.

5. The adapter of claim 1, wherein said adapter further comprises a cap slidably mounted on said handle, wherein said cap may be positioned to prevent the tubes from vibrating out of said apertures.

6. The adapter of claim 1, wherein each of said aperture extends along the length of said base and has a length less than the predetermined length of a tube whereby the lower portion of the tube extends below said base from said aperture.

7. The adapter of claim 1, formed from an optically transparent plastic.

8. The adapter of claim 7, wherein said plastic is radiopaque.

9. A method for vortexing a plurality of tubes, comprising the steps of providing a vortex adapter suitable for holding a plurality of tubes to be vortexed and for subjecting the tubes simultaneously to vortex forces, said adapter being adapted for use with a vortexing machine having a vibrating cup, said adapter comprising:

an elongated handle;

a base connected to said handle with said handle extending above said base, said base comprising a plurality of fixed apertures sized to receive a plurality of tubes respectively; said apertures having an upper portion and a lower portion with said upper portion positioned closer to the top of said base then said lower portion; and a nipple connected to and positioned below said base, wherein said nipple is constructed and configured to be received into the cup of the vortexing machine while said adapter is held at said handle, and wherein said nipple, said base, and said handle are structurally associated in a manner whereby vibration of said nipple by insertion into the vibrating cup causes vibration rotation of said base and causes tubes held within said apertures in said base to be subject to vortex forces, wherein said adapter has a first longitudinal axis parallel to said handle, and a said aperture forms a second longitudinal axis extending from said upper portion to said lower portion, and wherein said first and second axes form an acute angle to each other wherein the distance of said second axis from said first axis in said upper portion is greater than the distance of said second axis from said first axis in said lower portion; inserting a plurality of tubes into said apertures, and holding said nipple within the cup of the vortexing machine.

10. The method of claim 9, further comprising providing a stand adapted to hold said adapter in a vertical position, said stand comprising an aperture adapted to receive said nipple, placing said adapter in said stand prior to said inserting step, and removing said adapter from said stand after said inserting step.

* * * * *